US007644475B2

(12) United States Patent
Canady

(10) Patent No.: US 7,644,475 B2
(45) Date of Patent: Jan. 12, 2010

(54) CABLE TIE

(76) Inventor: Henry Canady, P.O.Box 159, Ravenal, SC (US) 29470

( * ) Notice: Subject to any disclaimer, the term of this patent is extended or adjusted under 35 U.S.C. 154(b) by 382 days.

(21) Appl. No.: 11/676,601

(22) Filed: Feb. 20, 2007

(65) Prior Publication Data

US 2008/0196215 A1 Aug. 21, 2008

(51) Int. Cl.
*B65D 63/14* (2006.01)

(52) U.S. Cl. ..... 24/16 PB; 24/30.5 P; 24/17 AP

(58) Field of Classification Search ..... None
See application file for complete search history.

(56) References Cited

U.S. PATENT DOCUMENTS

| | | | | |
|---|---|---|---|---|
| 3,186,047 | A | 6/1965 | Schwester et al. | |
| 3,488,813 | A | 1/1970 | Kohke | |
| 3,530,544 | A * | 9/1970 | Burniston | 24/16 R |
| 3,739,430 | A | 6/1973 | Kohke | |
| 3,754,304 | A | 8/1973 | Modrey | |
| 3,892,011 | A * | 7/1975 | Kohke | 24/16 PB |
| 5,517,727 | A | 5/1996 | Bernard et al. | |
| 5,517,728 | A | 5/1996 | Woods | |
| 6,701,579 | B1 * | 3/2004 | De La Pena | 24/16 PB |
| 7,360,281 | B1 * | 4/2008 | MacCartey et al. | 24/16 PB |

* cited by examiner

*Primary Examiner*—Jack W. Lavinder
(74) *Attorney, Agent, or Firm*—B Craig Killough; Ernest B. Lipscomb, III

(57) ABSTRACT

There is provided an improved cable tie made of integrally molded thermoplastic material that includes a head, a strap that has a near end, a tail end, and an elongated body portion between the near end and the tail end. The strap includes a gripping surface formed on the upper surface of the tail end. The head is attached to the near end. The head has an opening extending there through that is slightly larger than the strap for receiving the tail end of the strap. A locking means is positioned within the head and extends into the opening and is formed to engage the gripping surface to prevent the strap from loosening once the strap is tightened. A blade is located within the head such that blade may be moved so as to cut the excess portion of said tail end once the strap is tightened. The blade extends through a portion of the wall of the head. The remaining end of the strap is recessed within the slot so that the end, if sharp, is not exposed.

14 Claims, 2 Drawing Sheets

CABLE TIE

BACKGROUND OF THE INVENTION

1. Field of the Invention

The present invention relates to an improved cable tie for bundling wires, electrical cables and the like. More specifically, the present invention relates to an improved cable tie having a blade located in the head of the cable tie for severing the excess portion of the tail.

2. Description of Related Art

Cable ties generally comprise an elongated strap, commonly of a thermoplastic material, and a head having an opening extending there through. The head is usually, but not necessarily, formed integrally with the strap at one end. The head includes a means for engaging the strap which allows the free end of the strap to be inserted through the head to form a loop, and pulled through to reduce the loop size, but prevents the strap from being pulled in a reverse direction to expand the loop size.

After a cable tie secures a bundle of articles a "tail" extends from the head of the cable tie. In common practice, the tails are cut off with wire cutters or dikes. This method does not eliminate the tail but rather leaves a short tail extending from the head of the cable tie. The problem with the short tail is that it also has very sharp edges. If someone accidentally rubs against the tail, the sharp edge would likely cut the skin. It is therefore desirable to provide a cable tie whereby the excess portion of the tail is completely removed.

Cable ties for severing the unwanted tail portion of the tie strap are known. One attempt to solve this problem is described in U.S. Pat. No. 6,701,579 in which the cable tie head includes a blade extending through the head and located on the same side of the head portion as the locking means. The excess portion of the strap is cut when torsion is applied to the body portion by twisting the strap and forcing the body of the strap against the blade.

Another such cable tie is described in U.S. Pat. No. 3,892,011 in which the head portion of the cable tie is provided with a severing means that includes a blade portion and comprises a free end adapted to engage the strap body portion upon insertion through the opening in the head after being looped about an article or articles. The excess portion of the strap extending beyond the head portion is removed by looping the strap body about the article to be bundled, advancing the strap body through the head portion opening to the desired tightness, and then twisting or otherwise urging the excess portion of the body portion to cause the body portion to be urged against the blade sufficiently to effect complete severance of the excess body portion.

SUMMARY OF THE INVENTION

It is an object of the invention to provide an improved cable tie having a severing blade positioned in the head of the tie to sever the tail of the cable tie strap.

Another object of the present invention is to provide a simple and speedy means to remove the excess portion of a cable tie strap when articles have been bundled.

The cable tie of the present invention includes a head, a strap that has a near end, a tail end, and an elongated body portion between the near end and the tail end. The strap includes a gripping surface formed on the upper surface of the tail end. The cable tie is preferably made of integrally of thermoplastic material. The head is attached to the near end of the strap. The head has a transverse opening extending through the head slightly larger than strap for receiving the tail end of the strap. The opening in the head is defined by an end wall, a front wall and a pair of sidewalls. A locking means is positioned within the head and extends into the opening and is formed to engage the gripping surface located on the tail end of the strap to prevent the strap from loosening once the strap is tightened. The locking means is partly imbedded into the front wall of the head and the free end extends into the transverse opening at a preferred angle of 30° to 60° to the axes of the strap, such that one end of the locking device is fixedly mounted within a head and the other free end acts as a strap retaining device. In one embodiment, the head has a region of flexure between the head and the strap whereby the strap is easily inserted and pulled through the opening.

A blade is located within the head such that the blade may be moved so as to cut the excess portion of said tail end once the strap is tightened. The blade extends through the end wall of the cable tie head. The blade is generally rectangular and the width is the width of the tail end of the strap. The forward end, i.e., the cutting edge is sharp while the rear end is blunted to provide a pushing surface. After the cable tie is tightened, the blade is pushed against and through the tail end of the strap that has passed through the transverse opening, and the sharp end of the blade cuts off the end of the strap extending from the head. The remaining end of the strap is recessed within the slot so that the end, if sharp, is not exposed.

In another embodiment, the blade is "u" shaped. The "u" shape provides two legs one of which serves as the cutting blade and the other of which serves as a gripping means. One leg the "u" shaped blade is sharp and cuts off the strap, while the other leg end has teeth that grip the end of the cut strap to hold it securely in place.

Other objects, features and advantages of the present invention will become apparent from the following detailed description of the invention taken in conjunction with the accompanying drawings.

BRIEF DESCRIPTION OF THE DRAWINGS

Having described the invention in general terms, reference will now be made to the accompanying drawings, which are not necessarily drawn to scale, and wherein.

DESCRIPTION OF THE PREFERRED EMBODIMENT(S)

The present inventions now will be described more fully hereinafter with reference to the accompanying drawings, in which preferred embodiments of the invention are shown. This invention may, however, be embodied in many different forms and should not be construed as limited to the embodiments set forth herein; rather these embodiments are provided so that this disclosure will be through and complete and will fully convey the scope of the invention to those skilled in the art. Like numbers refer to the elements throughout.

Figure 1:
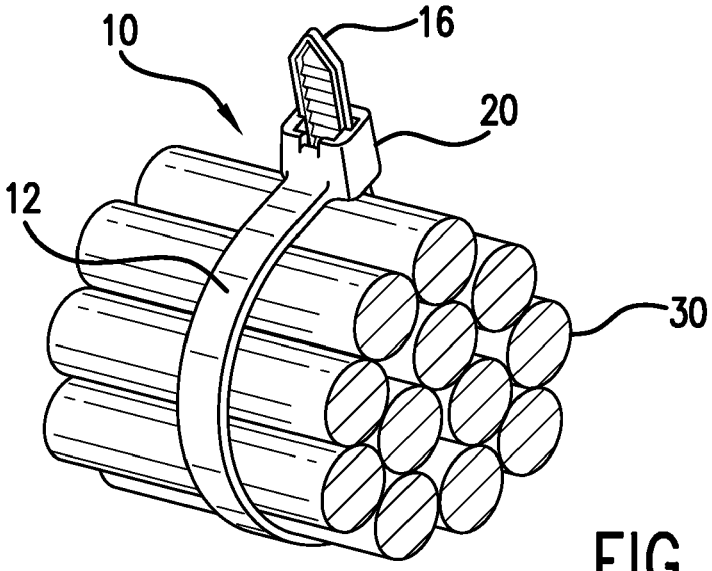
FIG. 1 is a perspective view of a typical cable tie securing a bundle of wires.

Referring now to FIG. 1 there is shown a perspective view of a typical cable tie 10 holding a group of wires 30 together.

As shown in FIG. 1 the strap 12 has the tail end 16 extending through and outward from the head 20 that provides not only an unsightly appearance but is often cumbersome and at times may be hazardous. The cable tie 10 of the present invention is somewhat like a typical cable tie in that it also has a strap 12 and a head 20.

Figure 2:
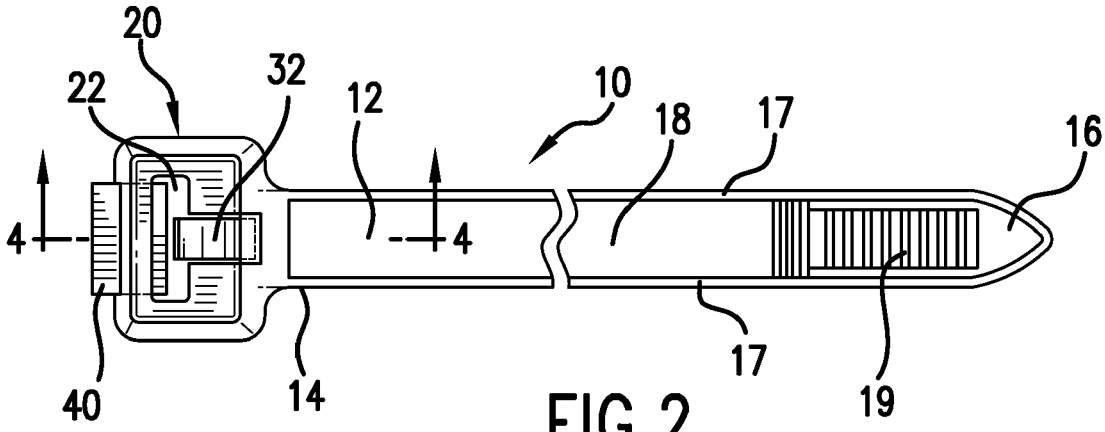
FIG. 2 is a top view of a cable tie of the present invention showing the head having a cutting blade and the strap.
Figure 3:
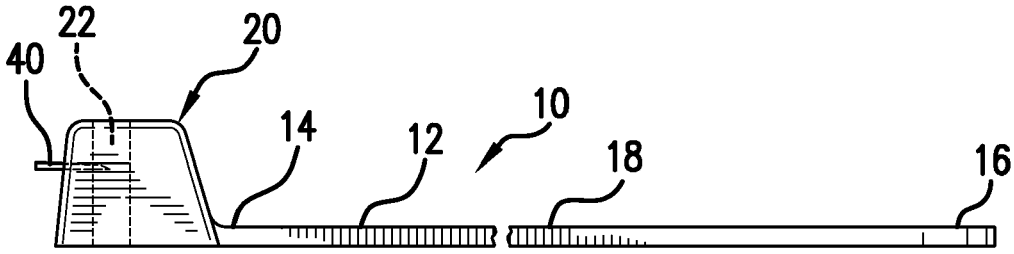
FIG. 3 is a side view of the cable tie of FIG. 2.

As shown in FIG. 2 and FIG. 3, the cable tie 10 of the present invention includes a head 20, a strap 12 that has a near end 14, a tail end 16, and an elongated body portion 18 between the near end and the tail end. The head 20 is molded to or attached to the near end 14. The strap 12 includes gripping surface 19 formed on the upper surface of the tail end 16 as shown in FIG. 2. Preferably the gripping surface 19 is formed as a series of ridges. Alternatively, the gripping surface 19 may be a series of indentures which provide a means for locking bundles of elongated items together. The tail end 16 may be angled and tapered, as shown in FIG. 2, and may also be provided with a pair of longitudinal ridges 17 extending along each side of the strap. The cable tie is preferably made of integrally molded of thermoplastic material.

Figure 4:
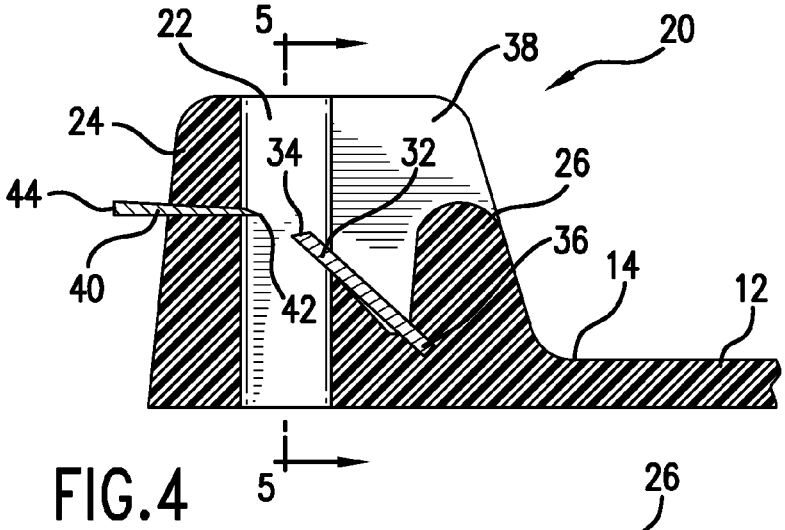
FIG. 4 is a sectional view of the cable tie head taken along lines 4-4 of FIG. 2.
Figure 5:
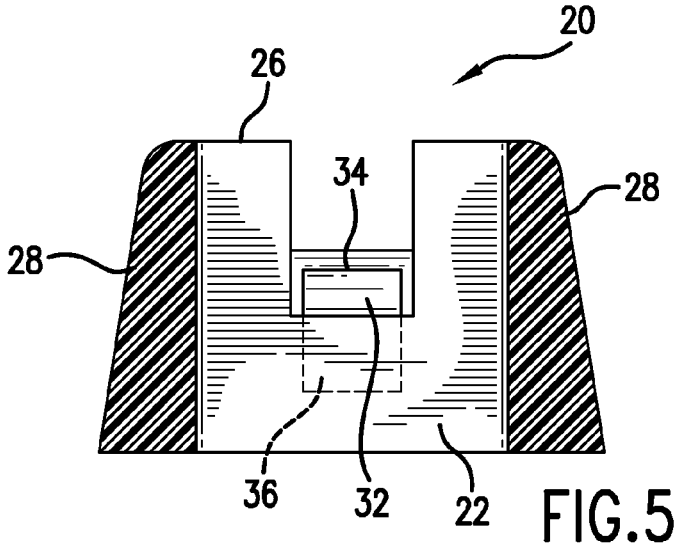
FIG. 5 is a sectional view of the cable tie head shown along lines 5-5 of FIG. 4.

The head 20, as shown in FIG. 2 and FIG. 4 has a transverse opening 22 extending through the head 20 slightly larger than strap 12 for receiving the tail end 16 of the strap 12. As shown in FIG. 4 and FIG. 5, the transverse opening 22 in head 20 is defined by rear wall 24, a front wall 26 and a pair of sidewalls 28. A locking means 32 is positioned within head 20 and transverse opening 22 and has a free end 34 formed to engage the gripping surface 19 located on the tail end 16 of the strap to prevent the strap from loosening once the strap is tightened and a rear end 36. The locking means 32 is generally rectangular and is partly embedded into front wall 26 of head 20 and extends into the opening 22 at a preferred angle of 30° to 60° to the axes of the strap 12, such that one end of arching device is fixedly mounted within a head and the other free end acts as a strap retaining device as shown in FIG. 4. The locking means 32 is slightly narrower than the gripping surface and may be made of metal or other suitable rigid material. A region of flexure between the read end 36 and the free end 34 of locking means 32 allows the strap 12 to be inserted and pulled through the transverse opening 22.

In one embodiment, that shown in FIG. 4 and FIG. 5, the head 20 may be molded such that an upper portion 38 of the front wall 26 above locking means 32 is eliminated. The eliminated area of front wall 26 leaves a molded area beneath the embedded portion of locking means 32.

As shown most clearly in FIG. 4 a blade 40 is located within the head 20 such that said blade may be moved so as to cut the excess portion of said tail end once the strap is tightened. The blade 40 may be generally rectangular and has a sharp end 42 for slicing of the excess of the tail end of the strap. The blade has an outer end 44 that is generally blunt so that the blade may be pushed through the strap. The blade 40 is preferably located on the opposite side of the head 20 from the locking means 32 and extends through the rear wall 24. In operation, once a bundle of wires or the like are secured by the strap in the manner shown in FIG. 1, the blade 40 is simply pushed through the tail end 16, thereby cutting the excess material from the tail end.

Figure 6:
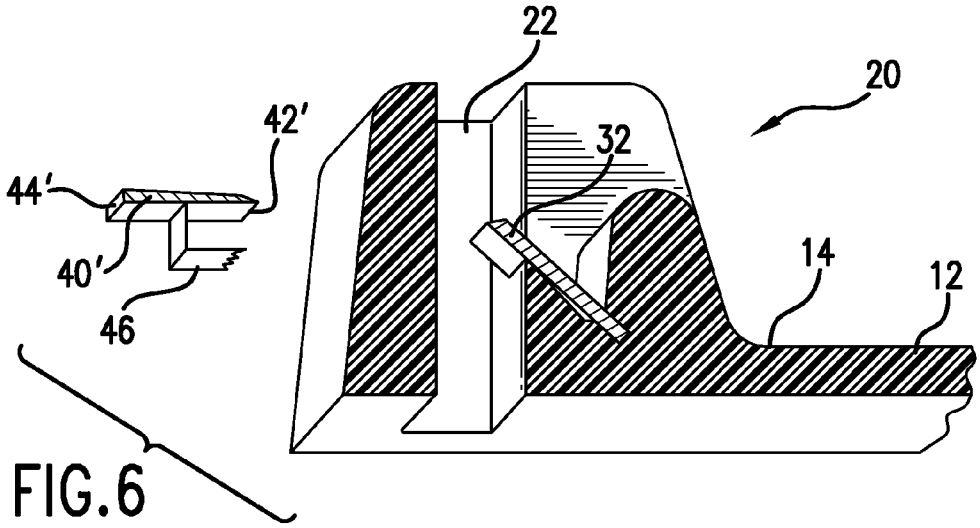
FIG. 6 is a view similar to FIG. 4 of another embodiment of the present invention showing a variation of the cutting blade.

In another embodiment, that shown in FIG. 6, the blade 40', when viewed from the side, appears in the shape of an "u" such that one of the legs 42' forms a sharp blade to cut the tail end of the strap and the other leg 46 has a series of teeth that grip the strap to hold it securely in place within the head. The outer end of the blade 44' is blunt so that the blade can be pushed through the tail end of strap 12. The end of blade 42' is sharp and cuts off the wire tie, while the other lower end has teeth that grip the wire tie to hold it securely in place.

Many modifications and other embodiments of the inventions set forth herein will come to mind to one skilled in the art to which these inventions pertain having the benefit of the teachings presented in the foregoing descriptions. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A cable tie comprising:

a strap including a near end, a tail end and an elongated body portion there between;

a head attached to said near end and having an opening extending through said head for receiving said tail end of said strap said head having a rear wall, a front wall and a pair of side walls;

a locking means positioned within said opening of said head formed to engage a gripping surface located on said tail end of said strap to prevent said strap from loosening once the strap is tightened; and a blade extending through said rear wall of said head, said blade being located on the opposite side of said strap from said locking means and positioned to cut the excess portion of said tail such that said blade may be moved so as to cut the excess portion of said tail end once the strap is tightened.

2. The cable tie according to claim 1 wherein said head is formed integrally with said strap.

3. The cable tie according to claim 1 wherein said head further comprises a region of flexure between said head and said strap engaging portion whereby said strap is easily inserted and pulled through said opening.

4. The cable tie according to claim 1 wherein said locking means is generally rectangular and slightly narrower than said gripping surface.

5. The cable tie according to claim 1 wherein said locking means is metal and capable of flexing.

6. The cable tie according to claim 1 wherein said blade is metal.

7. The cable tie according to claim 1 wherein said blade has a blunt outer end for pushing said blade through the tail of said strap.

8. A cable tie comprising:

a strap including a near end, a tail end and an elongated body portion there between;

a head attached to said near end and having an opening extending through said head for receiving said tail end of said strap;

a locking means positioned within said opening of said head formed to engage a gripping surface located on said tail end of said strap to prevent said strap from loosening once the strap is tightened; and a blade positioned within said head such that said blade may be moved so as to cut the excess portion of said tail end once the strap is tightened, wherein said blade when viewed from the side is shaped in the shape of a "u" such that one of the legs forms a sharp blade to cut the tail end of the strap and the other leg has a series of teeth that grip the strap to hold it securely in place within said head.

9. The cable tie according to claim 8 wherein said head is formed integrally with said strap.

10. The cable tie according to claim 8 wherein said head further comprises a region of flexure between said head and said strap engaging portion whereby said strap is easily inserted and pulled through said opening.

11. The cable tie according to claim 8 wherein said locking means is generally rectangular and slightly narrower than said gripping surface.

12. The cable tie according to claim 8 wherein said locking means is metal and capable of flexing.

13. The cable tie according to claim 8 wherein said blade is located on the opposite side of said head from said locking means and positioned to cut the excess portion of said tail.

14. The cable tie according to claim 8 wherein said blade has a blunt outer end for pushing said blade through the tail of said strap.

* * * * *